US007270033B1

(12) United States Patent
Williams et al.

(10) Patent No.: US 7,270,033 B1
(45) Date of Patent: Sep. 18, 2007

(54) WRENCH FOR ADJUSTING CASTER AND CAMBER ON A MOTOR VEHICLE

(75) Inventors: Danny L. Williams, Clarinda, IA (US); Mark Fogelstrom, Omaha, NE (US); Jerrel G. Jensen, Kansas City, MO (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 11/559,795

(22) Filed: Nov. 14, 2006

(51) Int. Cl.
*B25B 13/06* (2006.01)
*B25B 13/00* (2006.01)
*B25B 23/16* (2006.01)

(52) U.S. Cl. ..... 81/121.1; 81/124.3

(58) Field of Classification Search ..... 81/121.1, 81/176.1, 119, 177.1, 125.1, 124.3; D8/27, D8/28

See application file for complete search history.

(56) References Cited

U.S. PATENT DOCUMENTS

| | | | | |
|---|---|---|---|---|
| 1,256,216 | A * | 2/1918 | Fessler | 81/177.85 |
| 5,595,097 | A * | 1/1997 | Anderson | 81/125.1 |
| 7,137,319 | B2 * | 11/2006 | Hough | 81/60 |
| 2002/0088314 | A1 * | 7/2002 | Wambem | 81/125.1 |
| 2003/0066393 | A1 * | 4/2003 | Mageson | 81/125.1 |

OTHER PUBLICATIONS

OTC Catalog, p. 89, Product No. 7829, Ford Caster/Camber Adjusting Wrench.

* cited by examiner

*Primary Examiner*—David B. Thomas
(74) *Attorney, Agent, or Firm*—Banner & Witcoff, Ltd.

(57) ABSTRACT

A specialty wrench includes a socket with a specially shaped handle attached thereto and arranged symmetrically with respect to its attachment to the socket to enable the socket to be placed on a fastener associated with a caster/camber adjustment cam in a left hand or a right hang sense.

1 Claim, 3 Drawing Sheets

WRENCH FOR ADJUSTING CASTER AND CAMBER ON A MOTOR VEHICLE

BACKGROUND OF THE INVENTION

In a principal aspect the present invention relates to a specialty wrench useful for adjusting the caster and camber setting cam located and incorporated in the suspension system of various vehicles wherein access to the fastener which holds the cam in position is severely restricted.

The suspension system of many vehicles typically includes, particularly in association with the front wheel steering system, means for adjusting the caster and camber of the wheels. Adjustment is often effected by providing a cam adjustment for the control arm of the steering system. Adjustment of the cam relative to the control arm to correct the alignment angles of the vehicle wheels may thus be effected and such an undertaking is typically accomplished by releasing a bolt or other type of fastener which holds the cam in position so that the cam may be rotated. Then upon rotation of the cam to the appropriate camber and/or caster position, the fastener, such as the bolt and nut holding the cam in place, may be tightened. Various vehicles have such an arrangement. However, the access to the fastener for the adjustment cam is often located in an almost inaccessible position. Vehicles which exhibit such limited or restricted access include Ford Explorer vehicles, Ford F150 Pick Up vehicles and Ford Ranger vehicles.

Heretofore, a product has been available for adjustment to such a cam. More particularly, OTC offers a product, No. 7829 identified as a Ford Caster/Camber Adjusting Wrench. The wrench generally includes a socket at one end oriented in a first direction connected to a second socket at the opposite end oriented in a direction generally parallel to the first socket. In order to utilize such a device, a ratchet wrench is required to drive and move the wrench about the axis of the sockets in order to loosen or tighten the fastener associated with the cam of the steering and alignment system. The use of an extra tool in such an operation is a disadvantage. Moreover, the tool has the further disadvantage that it is difficult to position properly in order to effect its operation.

Thus, there has developed a need for an improved specialty wrench useful in the repair and adjustment of motor vehicle suspension and steering systems.

SUMMARY OF THE INVENTION

Briefly, the present invention comprises a specialty wrench for use in environments of the type described in the Background. The wrench includes a generally cylindrical socket at one end connected to a specially configured flat plate wrench arm. That is, the wrench arm includes a first arcuate section extending at least along an arc of 100° and connected to a straight line mid-section and thence further connected to a generally straight hand grip section which is angled with respect to the straight line section. The various sections of the unitary handle are described hereinafter in the context of their relationship to the radius of the arc and the diameter of the cylindrical socket. Importantly, the socket is open at both ends in order to permit it to be used as a left-handed wrench as well as a right-handed wrench.

Thus, it is an object of the invention to provide an improved specialty wrench useful in the repair and adjustment of vehicle steering and/or suspension systems and, in particular, steering systems wherein a caster/camber cam is held in place by a fastener and access to the adjustable cam and its fastener is highly restricted.

A further object of the invention is to provide a specialty wrench which is useful in both a left hand and a right hand sense in order to effect adjustment of caster and camber on a motor vehicle suspension system.

Another object of the invention is to provide a rugged, inexpensive and utilitarian wrench for the adjustment of caster and camber cams on a motor vehicle.

These and other objects, advantages and features of the invention will be set forth in the detailed description which follows.

BRIEF DESCRIPTION OF THE DRAWING

In the detailed description which follows, reference will be made to the drawing comprised of the following figures.

DETAILED DESCRIPTION OF AN EMBODIMENT OF THE INVENTION

Figure 1:
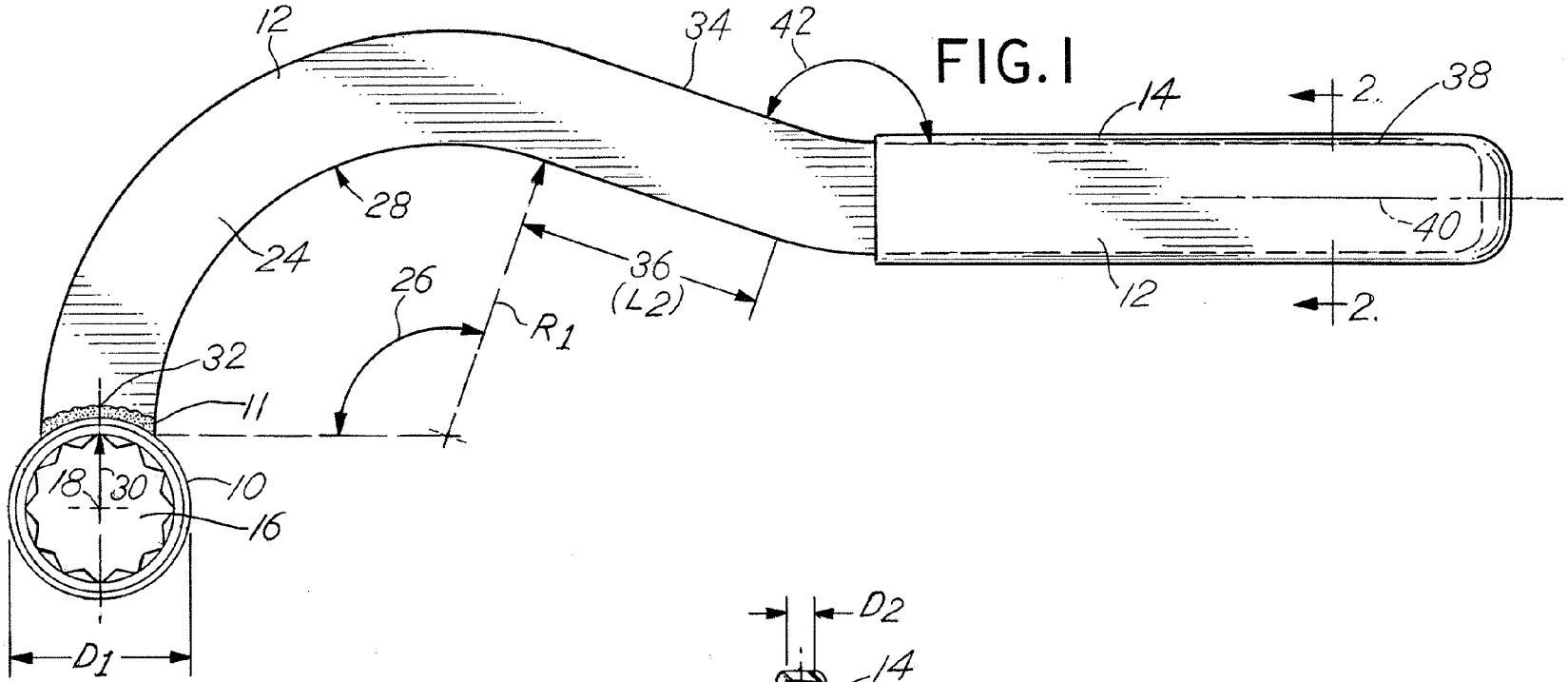
FIG. 1 is a side elevation of the wrench tool in an embodiment of the invention.

Referring to the figures, the wrench depicted as an embodiment of the invention includes a socket 10, a handle 12 and a hand grip 14. The socket 10 includes a throughbore 16 which is internally faceted in order to fit over and engage the head of a fastener such as a nut or bolt. Throughbore 16 includes a centerline axis 18 and an external diameter, $D_1$. Typically, the socket 10 includes a longitudinal or axial dimension, $L_1$, in the range of 0.75 inches. However, the axial extension of the socket 10 may vary upwards to about at least 1.25 inch and still be highly utilitarian in the environment described.

Figure 2:
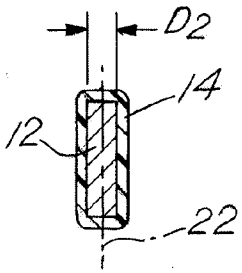
FIG. 2 is a cross sectional view of a section of the handle of the wrench of FIG. 1 taken along the line 2-2 in FIG. 1.
Figure 3:
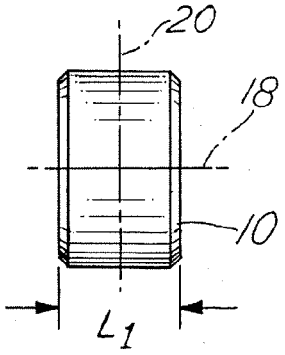
FIG. 3 is a plan view of the socket incorporated in the embodiment of FIG. 1.
Figure 4:
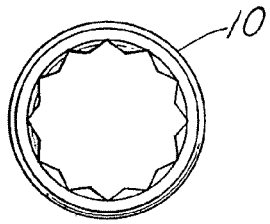
FIG. 4 is an end view of the socket of FIG. 3.

The handle 12 is typically fabricated from a plate steel material and is in the form of a flat plate having a thickness $D_2$ as depicted in FIG. 2. The thickness of the plate $D_2$ is typically less than the diameter of the socket 10; namely, diameter $D_1$. Additionally, the thickness of the plate handle $D_2$ is typically less than the axial dimension, $L_1$, of the socket 10. Further, the handle 12 is attached to the socket 10 so that it is symmetrically arrayed. That is, a midline or bisecting line 20 of the socket 10 as shown in FIG. 3 is aligned with a centerline 22 of the handle 12 as depicted in FIG. 2. Thus, the handle 12 is attached to the socket 10 so that the socket 10 will extend laterally in opposite directions from the planar outside faces of the handle 12 a uniform distance on each side thereof. This facilitates the use of the wrench depicted in the embodiment as a left-handed wrench or a right-handed wrench.

The handle 12 includes an arcuate section or run 24 which extends from a welded connection 11 to the socket 10 in an arc 26 in the range of 100° to 125°±5°. The arc 26 on the inside face of the handle; namely, inside face 28 has a radius $R_1$. The radius $R_1$ is about 3/2 the diameter of $D_1$ of socket 10. The handle 12 is welded to the socket 10 so that a radius of the socket 10; namely, radius 30, is aligned with a mid-point 32 of the handle 12 where the handle 12 is welded to the socket 10.

The handle 12 further includes a first straight or mid-section 34 attached to the arcuate section 24 and constitutes an extension thereof having a dimension or length $L_2$ in the range of at least about 1/2 $R_1$ but no greater than about 3/2 $R_1$. The length 36 ($L_2$) of the first section 34 extending from the arcuate section 24 is preferably 2/3 $R_1$.

The first straight or mid-section 34 connects to a second generally straight section 38 which includes a centerline axis 40 generally perpendicular to the radius 30 as depicted in FIG. 1. Thus, the angular relationship or angle 42 between first section 34 and second section 38 is in the range of 155° to about 170°. The length of the second section 38 in the direction of the axis 40 is typically in the range of at least about $R_1$ and preferably about 2 times $R_1$.

The described dimensional relationships become highly important with respect to the utility of the tool and result in a tool with a relationship of corresponding parts that enable it to be used in spaces that are highly restricted, yet easily gripped and manipulated both in a left hand and a right hand sense.

Figure 5:
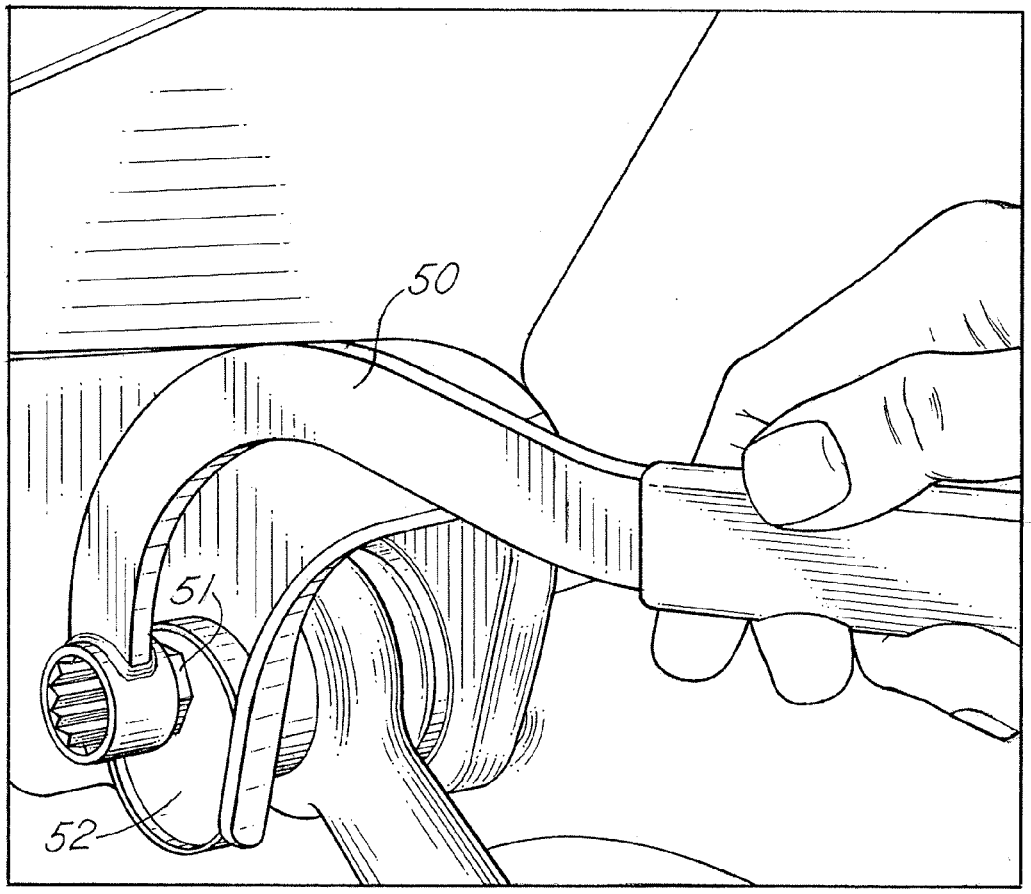
FIG. 5 is an isometric view of the embodiment and tool of FIG. 1 depicted in the typical environment in which it is used for engaging a fastener of an adjustment cam associated with adjusting caster and/or camber of a motor vehicle suspension system.

FIG. 5 illustrates the use of the tool 50 for engagement with a nut or fastener 51 utilized to hold a cam 52 of a suspension system in a motor vehicle. By manipulating the wrench 50, the fastener 51 which is gripped by the socket 10 of the tool 50 may be loosened. The camber or caster cam 52 may then be adjusted. Subsequently, the fastener 51 may be retightened by manipulation of the tool 50 and, more particularly, rotation of the socket 10 thereof.

Figure 6:
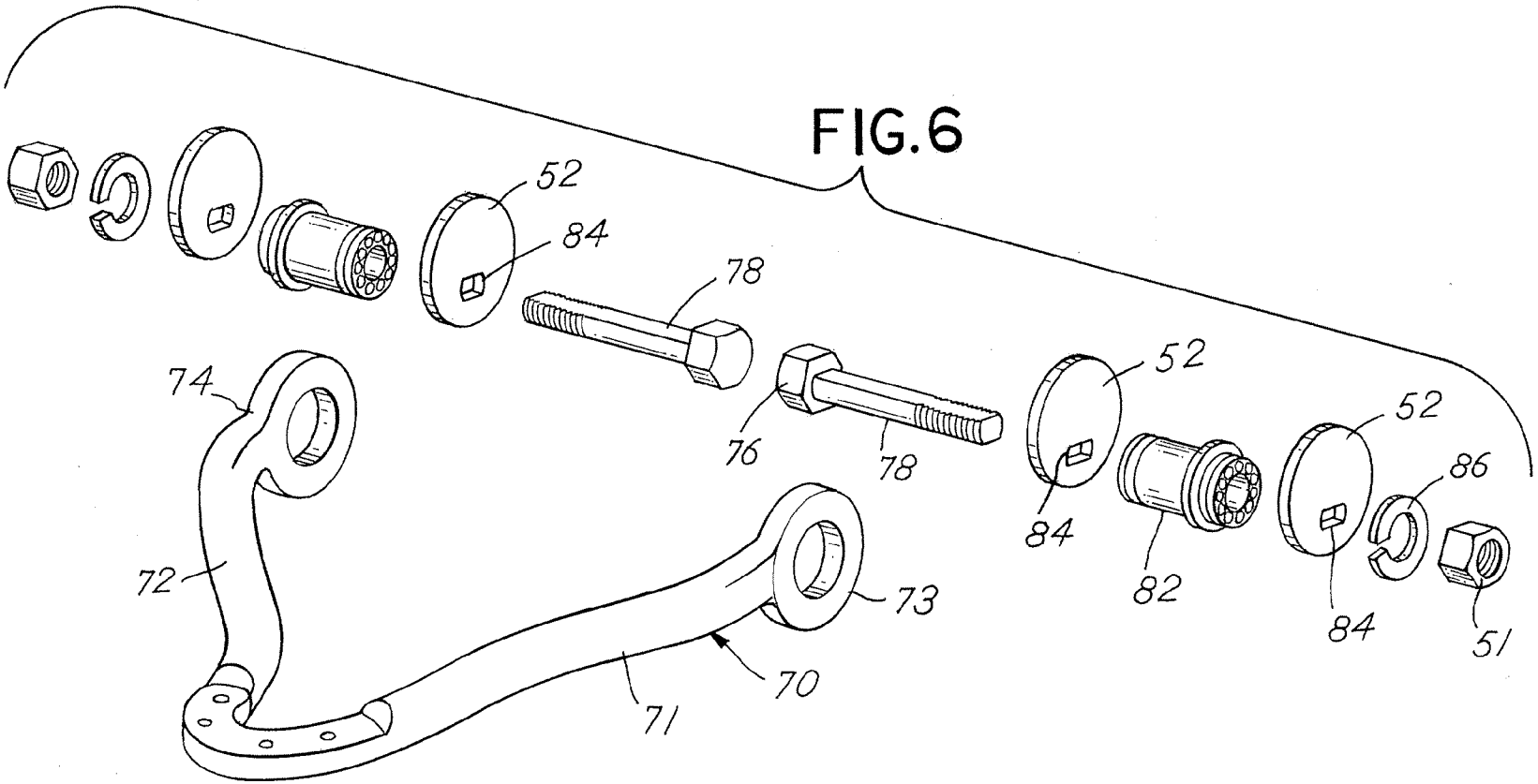
FIG. 6 is an isometric view of a portion of a suspension which is susceptible to adjustment using the tool of the invention.

FIG. 6 depicts an exploded isometric view of a typical component of a suspension system which includes a cam 52 of the type which is susceptible of adjustment using the described tool. A suspension yoke 70 includes a right hand arm 71 and a left hand arm 72 with spaced, annular attachment rings 73 and 74, respectively. The right hand ring 73 receives an adjustable caster/camber assembly including a bolt 76 with a shaft 78 keyed through a compatibly shaped slot in a cam 52 as well as through a bearing 82, a second cam 52 with keyed slot 84, washer 86 and nut or fastener 51. The left hand arm 72 has a similar cam 52 arrangement. The described tool 50 is especially designed to engage nut 51 of either arm 71, 72.

While there has been set forth a preferred embodiment of the invention, it is to be understood that the invention is to be limited only by the following claims and equivalents thereof.

What is claimed is:

1. A specialty wrench for engagement with a polygonally headed fastener located intermediate interfering structure which generally precludes attachment and rotation of a socket on said fastener, said wrench comprising, in combination:

a generally circular, cylindrically configured socket including a faceted throughbore, an axis of rotation, opposite ends and an external diameter $D_1$;

a unitary handle in the form of a generally flat plate lying in a plane perpendicular to the axis of rotation of said socket, said handle fixed to and extending radially outwardly from said socket, said handle having a first side edge to side edge generally uniform dimension $D_2$ less than $D_1$, said handle configured in the form of an arc section extending from the socket having an arc in the range of about 100° to 125° and a radius $R_1$ where $R_1$ is greater than about 3/2 $D_1$, said arc section connected to the socket along a radius of the socket and generally midway between the opposite ends of the socket, said arc section joined to a first generally straight mid-section said first section greater in length than 2/3 $R_1$ and less than about 3/2 $R_1$, said first section connected to a second, generally straight section greater in length than about $R_1$ and forming an angle of about 155° to 170° with said first section; and said second section generally perpendicular to the radius extending from the connection of the handle to the socket; and a handle grip on said second section.

* * * * *